US007967459B2

(12) United States Patent
Schluep et al.

(10) Patent No.: US 7,967,459 B2
(45) Date of Patent: Jun. 28, 2011

(54) ACTIVATION DEVICE

(75) Inventors: Thomas P. Schluep, Mars, PA (US); Michael F. Stadler, Pittsburgh, PA (US); Zachary T. Casella, Aliquippa, PA (US)

(73) Assignee: Bea, Inc., Pittsburgh, PA (US)

( * ) Notice: Subject to any disclaimer, the term of this patent is extended or adjusted under 35 U.S.C. 154(b) by 417 days.

(21) Appl. No.: 11/452,495

(22) Filed: Jun. 14, 2006

(65) Prior Publication Data

US 2007/0290281 A1 Dec. 20, 2007

(51) Int. Cl.
*F21V 33/00* (2006.01)

(52) U.S. Cl. ..... 362/85; 362/24; 362/95

(58) Field of Classification Search ..... 362/24, 362/29, 85, 86, 88, 95, 812; 200/310, 313, 200/314, 317; 340/925; 345/170, 173, 174
See application file for complete search history.

(56) References Cited

U.S. PATENT DOCUMENTS

| | | | | |
|---|---|---|---|---|
| 4,665,324 | A * | 5/1987 | Ogino et al. | 200/313 |
| 4,811,175 | A * | 3/1989 | DeSmet | 362/95 |
| 5,278,362 | A * | 1/1994 | Ohashi | 200/314 |
| 5,537,300 | A * | 7/1996 | Kraines et al. | 362/86 |
| 5,718,326 | A * | 2/1998 | Larose et al. | 200/314 |
| 5,975,711 | A * | 11/1999 | Parker et al. | 362/24 |
| 5,993,019 | A * | 11/1999 | Kline et al. | 362/29 |
| 6,590,176 | B2 * | 7/2003 | Cole et al. | 200/310 |
| 6,664,489 | B2 * | 12/2003 | Kleinhans et al. | 200/313 |
| 6,967,587 | B2 * | 11/2005 | Snell et al. | 340/925 |

* cited by examiner

*Primary Examiner* — Y My Quach Lee
(74) *Attorney, Agent, or Firm* — The Webb Law Firm

(57) ABSTRACT

Disclosed is an activation device for use in initiating an event. This activation device includes an activation member with a body having a front surface and a rear surface. The illumination member is positioned substantially adjacent, spaced from or near to the rear surface of the body of the activation member. The illumination member projects physical waves toward the rear surface of the body of the activation member. A method of manufacturing an activation device is also disclosed.

14 Claims, 3 Drawing Sheets

ACTIVATION DEVICE

BACKGROUND OF THE INVENTION

1. Field of the Invention

The present invention relates generally to devices and mechanisms used to communicate with, interact with and/or activate other mechanisms, such as doors and the like and, in particular, to an activation device for use in initiating an event.

2. Description of Related Art

In the field of mechanism activation, such as opening and closing a door, activating a ramp, initiating some mechanical, electrical or electromechanical event, etc., one common use of such an activation device is in the form of an actuatable button or surface positioned on or near the mechanism that is to be activated. As discussed, in one embodiment where the device to be activated is an automatic door, a push-button or contact-less plate is often placed on the door frame or on a wall adjacent to or leading to the door opening. For example, in a hospital environment, a push-button plate (and accompanying mechanism) is placed on the wall surface in the hall leading to the door.

Presently, activation mechanisms and devices are available in a wide variety of structures, building, walls, surfaces, etc. In order to ensure that the user can appropriately actuate the device, the device must be positioned in an easily visible and well-lit area. However, such optimal positioning may not always be available, for example, in an outside location that is in a shadowed area, a darkened hallway or room, etc. Therefore, there remains a need for an activation device that is either illuminated or specifically lighted to allow for easy location and use.

Further, activation mechanisms and devices are typically flat surfaces with some adornment or message thereon to indicate what actuating the device will accomplish. Therefore, there is considerable room in the art for additional decorative and functional concepts that increase the viability of the message and the ornamental quality of the device. In addition, prior art activation devices are neither configurable nor dynamic and are normally cast with the message or indication. Accordingly, there remains a need for an activation mechanism or device that allows for a configurable and dynamic message or indication, such that the device can be used in a variety of applications and situations, and in connection with varying other mechanisms.

As discussed above, prior art activation devices typically include an often flat, metallic surface with a message, sign or indication disposed thereon. As one would expect, the device is in a high-traffic area, such as an entryway, hallway, etc. Therefore, the device, and in particular, the surface of the device, provides a unique opportunity to display a variety of messages, images, videos, sounds, etc. to a user. For example, the activation device may be used for advertising or displaying other messages, images, videos, sounds, etc. to the user, whether prior to, during or after actuation. In addition, this message may be configurable or dynamic. Thus, there remains a need in the art for an activation device that provides such messages and effectively uses the unique opportunity to provide a message, data or information to a user, due to the unique location and positioning of the activation device.

Overall, prior art activation devices are simple, and typically push-button activated, mechanisms that only serve the specific utilitarian purpose of initiating an event, such as opening and closing a door. Accordingly, there is a need in the art for actuation and activation devices and mechanisms that offer additional and beneficial functional and ornamental benefits.

SUMMARY OF THE INVENTION

It is, therefore, one object of the present invention to provide an activation device that overcomes the deficiencies and drawbacks of prior art activation devices and mechanisms. It is another object of the present invention to provide an activation device that provides for some illumination or other lighting source for the activation device. It is yet another object of the present invention to provide an activation device that includes a configurable and/or dynamic message or indication function. It is still another object of the present invention to provide an activation device that provides additional ornamental and functional aspects as compared to prior art devices.

Accordingly, the present invention is directed to an activation device for use in initiating an event. The device includes an activation member having a body with a front surface and rear surface. An illumination member is positioned substantially adjacent or spaced from the rear surface of the body of the activation member and projects visible waves toward the rear surface of the body of the activation member. In one embodiment, the device includes one or more cut-out portions extending at least partially through the body of the activation member. In this embodiment, the illumination member projects through the cut-out portions of the body of the activation member. Further, these cut-out portions may, together, form a design, e.g., a sign, at least one word, at least one number, at least one symbol, a phrase, a direction, a representation, a figure, an image, an alphanumeric character, or any combination thereof.

The present invention is further directed to a method of manufacturing an activation device. The method includes the steps of: (a) forming an activation member having a body with a front surface and a rear surface; and (b) positioning an illumination member substantially adjacent or spaced from the rear surface of the body of the activation member, such that, in operation, the illumination member projects visible waves toward the rear surface of body of the activation member. In one embodiment, the method further includes the steps of: forming one or more cut-out portions extending at least partially through the body of the activation member; and at least partially filling the cut-out portions with a material. These cut-out portions may be formed through a laser cutting process, a water jet cutting process, a chemical etching process, stamping process, assembly process or any combination thereof. Further, the material used to fill the cut-out portions may be an epoxy, a resin, a polymer, a plastic, a transparent material, a semi-transparent material, a colored material, a glass, or any combination thereof.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1:
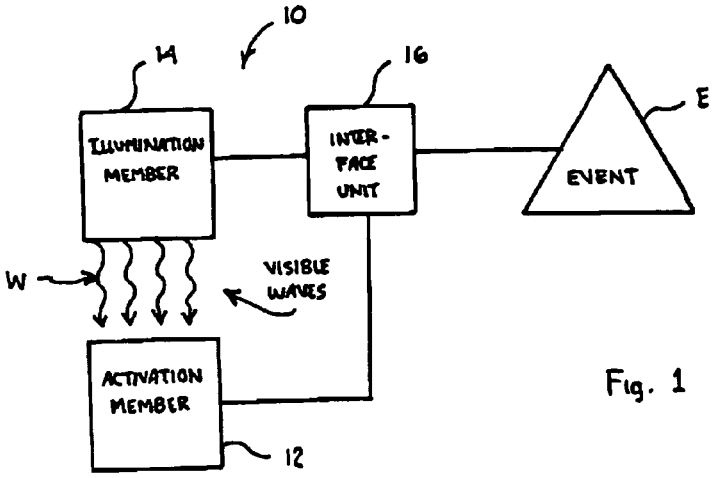
FIG. 1 is a schematic view of an activation device according to the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to an activation device 10, which is illustrated in various preferred and non-limiting embodiments in FIGS. 1-11. In particular, the activation device 10 can be used to initiate an event E, such as opening a door D, actuating some other mechanism, starting a process, activating a machine, lifting or lowering a device, such as a ramp, etc. Accordingly, the activation device 10 of the present invention can be used in a variety of situations and applications in order to initiate some desired event E. Therefore, while the present invention discusses the use of the activation device 10 in connection with opening and closing a door, such an embodiment is not intended to be limiting in any manner whatsoever, and the event E can be any desired event E or operation that can be initiated or activated.

The activation device 10 includes an activation member 12, which is used to allow a user to provide some type of signal or indication that the event E should be initiated. For example, this user indication may be audible, tactile, motion-derived, contact-derived, contact-less, etc. In addition, the activation device includes an illumination member 14. The illumination member 14 projects visible waves W toward the activation member 12. As discussed hereinafter, the illumination member 14 may be a variety of members, source components, combinations of components, etc.

As seen in FIG. 1, the activation member 12 and/or the illumination member 14 are in communication with an interface unit 16, which may house the appropriate mechanical and electrical systems and structure in order to communicate with and/or initiate the desired event E, such as opening the door D. For example, the activation member 12 may be in operative communication with the interface unit 16, which may be in the form of a housing or enclosure, which is in electrical communication with another system or mechanical operation for initiating the event E.

In one embodiment, the activation member 12 includes a body 18 having a front surface 20 and a rear surface 22. Accordingly, in operation, the illumination member 14 is positioned substantially adjacent, spaced from (such as near another component of the device 10) or near the rear surface 22 of the body 18, and further, the illumination member 14 projects the visible waves W toward the rear surface 22 of the body 18. In this manner, the activation member 12 is at least partially illuminated or otherwise lit for display, visibility and ornamental purposes.

Figure 2:
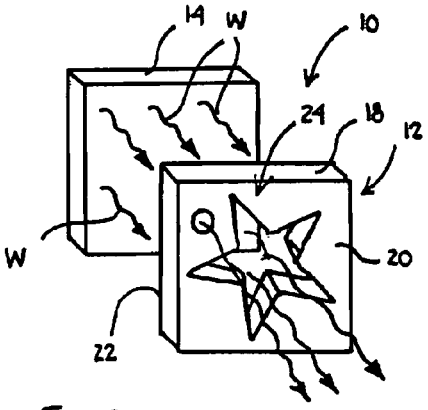
FIG. 2 is a perspective view of one embodiment of an activation device according to the present invention.

As seen in FIG. 2, the body 18 of the activation member 12 may include one or more cut-out portions 24, which extend at least partially through the body 18. In operation, the illumination member 14 projects the visible waves W through at least one of these cut-out portions 24 of the body 18. Again, such an arrangement allows waves, light or other visible signals to be projected through the activation member 12 for use in communicating with or otherwise interacting with the user's perception.

Figure 3:
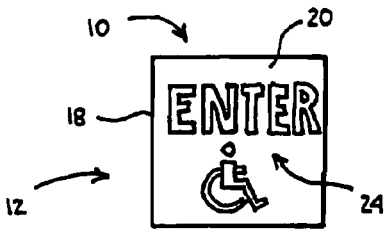
FIG. 3 is a front view of another embodiment of an activation device according to the present invention.
Figure 5:
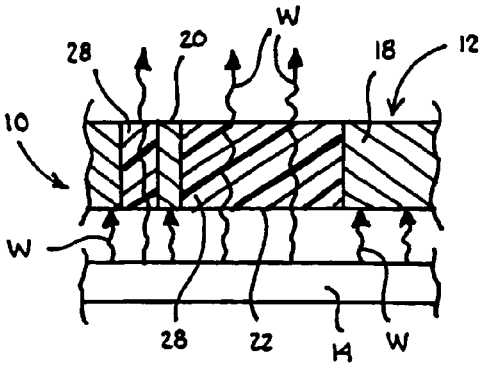
FIG. 5 is a side, sectional view of a further embodiment of an activation device according to the present invention.

As shown in FIG. 2, the cut-out portions 24 may form a desired design. For example, the design may be a sign, a word, phrase or message, a number, a symbol, a direction, a representation, a figure, an image, an alphanumeric character, etc. Accordingly, as shown in FIG. 3, the cut-out portions 24 form a word, namely "enter" as well as a symbol, together which represent a handicapped entrance. In this embodiment, the illumination member 12 would project the visible wave W, such as a light, through the word and symbol (in the form of the cut-out portions 24), such that the message and indication could be easily read and understood. Further, even in darkened positions, such as in a power loss situation, shadowed area, etc., the activation device 10 could be easily located by a user and the message understood regardless of these conditions.

Figure 4:
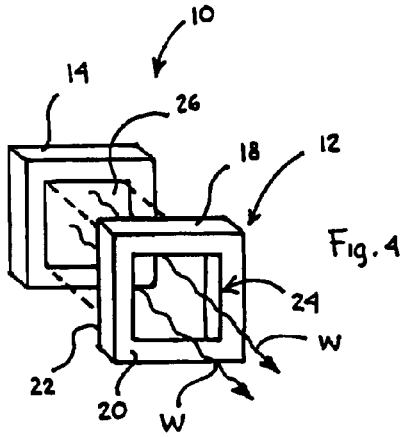
FIG. 4 is a perspective view of another embodiment of an activation device according to the present invention.

The illumination member 14 may take a variety of forms. For example, the illumination member 14 may be an LED source, an OLED source, a thin-film transistor source, a light, a lamp, a screen, a video display screen, a television screen, a monitor, a flat screen, a plasma screen, an LCD screen, an illumination source, etc. Turning to FIG. 4 in this preferred and non-limiting embodiment, the illumination member 14 is a screen surface 26. The screen surface 26, such as a plasma screen, flat screen or the like, projects through the cut-out portion 24. In this embodiment, the cut-out portion 24 is sized and shaped so as to allow the screen surface 26 to be at least partially visible through this portion 24.

Using the screen surface 26, a variety of messages can be displayed through the cut-out portion 24 and on the front surface 20 of the body 18 of the activation member 12. In this manner, a configurable and dynamic message can be displayed, and this message may relate information or data to the user, may indicate what activation of the member 12 will accomplish, and this message may be easily modified, such as through automated or electronic control.

It is envisioned that a variety of options can be considered when using this dynamic and configurable screen surface 26. For example, the screen surface 26 may periodically display advertisements or other data that may capture the user's attention before, during or after the user actuates the activation member 12. Further, the screen surface 26 may display a map of the location for the activation device 10 in connection with the remaining portions of the building or structure. Still further, it is envisioned that the screen surface 26 provides an interactive display, where the user can interact with a control program or other configurable interface to achieve certain desired actions or obtain data or information. In the map or directions example, the screen surface 26 may be interactive, such that the user may obtain directions to the position or location they wish to go. Accordingly, overall, the screen surface 26 may take a variety of forms and provide a variety of functions, which may help the user in his or her interaction with the activation device 10, the event E, a mechanism or system involved in the event E, or some other useful interaction. For example, the activation device may include an audio component, such as a speaker or the like, for use in producing audio signals, messages, sounds, music, announcements, etc. to the user. However, the screen surface 26 may be simply for display purposes only, and provide strictly ornamental features to the activation device 10.

In order to protect the illumination member 14, or alternatively, to enhance the ornamental quality of the activation member 12, the cut-out portions 24 may be at least partially filled with a material 28. See FIG. 5. In this preferred and non-limiting embodiment, the material 28 may be a rigid and at least partially transparent material 28, which allows the illumination member 14 to project the waves W therethrough. For example, the material 28 may be an epoxy, a resin, a polymer, a plastic, a transparent material, a semi-transparent material, a colored material, a glass, etc. Accordingly, the illumination member 14 may simply be a lamp or light that projects "white" light toward the rear surface 22 of the activation member 12, and the material 28 may be colored glass or some other synthetic material, such that a variety of colors may be obtained by choosing the appropriate material 28. Still further, in this embodiment, the body 18, and at least the front surface 20 of the body 18, is made from an opaque or non-transparent material, such as metal or the like. Therefore, the waves W only emanate through the material 28 of the cut-out portions 24.

Figure 6:
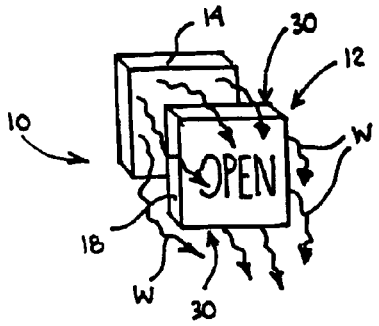
FIG. 6 is a perspective view of another embodiment of an activation device according to the present invention.

Another preferred and non-limiting embodiment is illustrated in FIG. 6. In this embodiment, the illumination member 14 projects light toward and around the rear surface 22 of the body 18 of the activation member 12. Accordingly, in this embodiment, the body 18 of the activation member 12 is solid, or at least opaque and non-transparent, and the waves W emitted from the illumination member 14 are visible around the perimeter area 30 of the front surface 20 of the body 18. In essence, a "back-lit" arrangement is obtained, and enough light provides an indication of the nature and function of the activation device 10.

Figure 7:
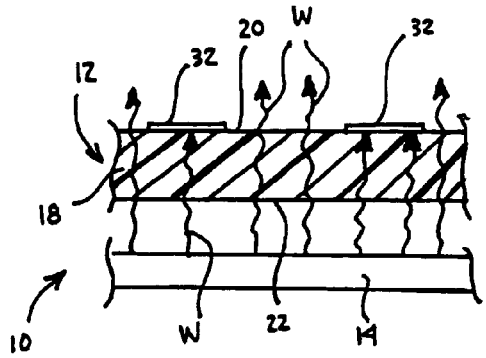
FIG. 7 is a side, sectional view of a still further embodiment of an activation device according to the present invention.

An inverse situation can also be obtained by applying opaque and non-transparent overlays 32 on top of the body 18, which, in this embodiment, is transparent. Therefore, as seen in FIG. 7, the waves W emanating from the illumination member 14 move through the body 18 and are visible by the user in the areas that are not covered with the overlay 32. Therefore, the overlay 32 or overlays may be formed in the desired design or pattern, and provide the appropriate message or indication associated with the activation device 10.

Figure 8:
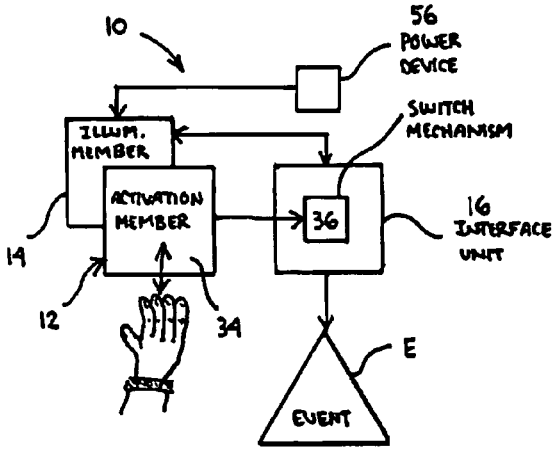
FIG. 8 is a schematic view of yet another embodiment of an activation device according to the present invention.

Turning now to FIG. 8, the activation member 12 may be in the form of a touch plate 34. In operation, when the touch plate 34 is contacted by the user, the event E is initiated. Further, in this preferred and non-limiting embodiment, the activation member 12 (or touch plate 34) is in communication with a switch mechanism 36, which may be a system or mechanism within the interface unit 16. In operation, when the switch mechanism 36 is actuated, the event E is initiated.

Figure 9:
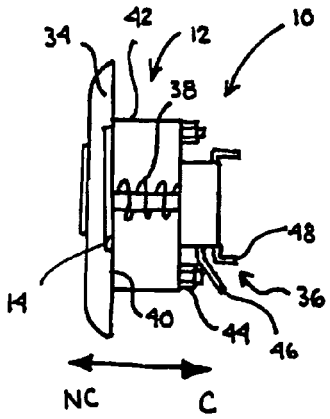
FIG. 9 is a side view of a further embodiment of an activation device according to the present invention.

In one specific embodiment, and as illustrated in FIG. 9, the touch plate 34 may be movable between a contact position C and a non-contact position NC. In this embodiment, the touch plate 34 is urged into a non-contact position NC by a spring mechanism 38. Specifically, the spring mechanism 38 is in direct or indirect contact with a rear surface 40 of the touch plate 34. Therefore, the touch plate 34 is urged away from the remaining portions of the activation device 10, such as the interface unit 16, etc. As seen in this embodiment, the spring mechanism 38 is positioned within a housing 42, which is a component of the interface unit 16. The housing 42 is movable between the non-contact position NC and the contact position C.

In this embodiment, the switch mechanism 36 includes a first contact member 46 and a second contact member 48. In operation, when the user urges the touch plate 34 between the non-contact position NC and the contact position C, the nut 44 urges the first contact member 46 to come in contact with the second contact member 48. This closes the circuit and provides some communication, such as electrical communication, in order to initiate the event E. Of course, any number of such switching arrangements are envisioned.

Figure 10:
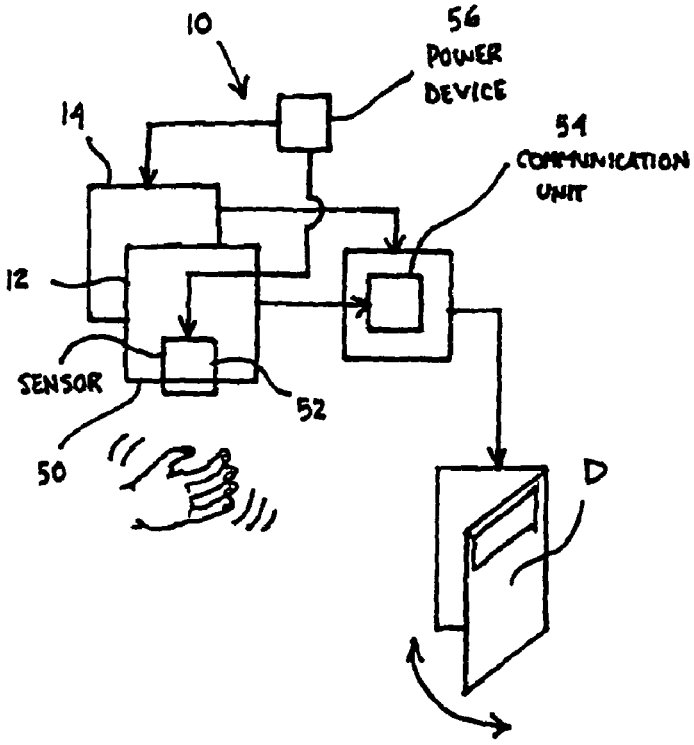
FIG. 10 is a schematic view of a still further embodiment of an activation device according to the present invention.

Another arrangement according to the present invention is illustrated in schematic form in FIG. 10. In this arrangement, the activation member 12 is a contact-less plate 50, which is in communication with or houses a sensor 52. The sensor 52 is in communication with a communication unit 54, which may be a part of the interface unit 16. In operation, through some contact-less interaction between the user and the sensor 52, a command is issued or other signal transmitted to initiate the event E through the communication unit 54.

A number of contact-less activities are understood to be within the scope of the present invention, for example, the sensor 52 may sense motion, audible signals, or may even require some other interaction with the user, such as a biometric interaction, etc. Of course, such biometric interaction verification could also be used in connection with the touch plate 34. The embodiment illustrated in FIG. 10 includes a sensor 52 that senses a user's motion, such as waving of the hand, which provides the command signal through the communication unit 54 to open the door D. Still further, the sensor 52 may be a capacitance plate or other member that changes capacitance based upon contact or contact-less interaction with the user. In addition, communication between the activation device 10 and the door D may be hardwired or wireless, and the door D may be any style of automatic door or door lock mechanism.

In order to provide current or power to the various components and sub-components of the activation device 10, a power device 56 may be utilized. For example, the illumination member 14, the switch mechanism 36, the sensor 52, etc. may be in electrical communication with the power device 56 and obtain current therefrom. This power device 56 may be part of the interface unit 16, or may be some separate electrical connection for use in connection with the activation device 10. In addition, the power device 56 may be a battery, such as a rechargeable battery, or a solar cell or battery obtaining solar power from ambient light, or even the illumination member 14. Still further, the power device 56 may be external power, a battery, a solar component, a piezzo component, a mechanical energy harvest component, etc.

Figure 11:
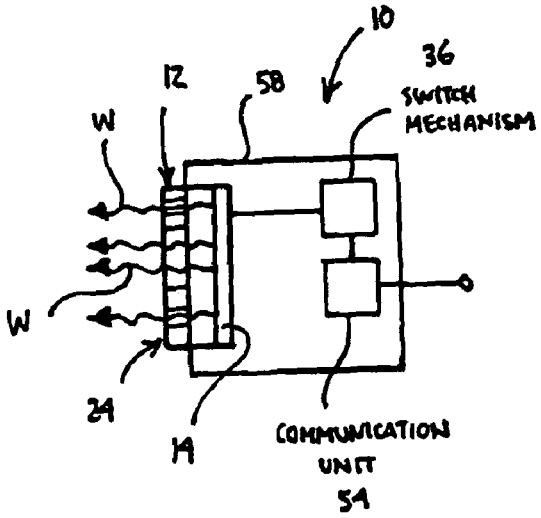
FIG. 11 is a schematic view of another embodiment of an activation device according to the present invention.

As illustrated in FIG. 11, the activation device 10 may be in the form of an enclosed housing 58 or box. In this manner, the activation member 12 would be in operable communication with the housing 58, and the illumination member 14, the switch mechanism 36, the communication unit 54, etc. would be housed within the enclosed housing 58. This would provide an easily portable and maintainable activation device 10.

In another aspect of the present invention, a method of manufacturing the activation device 10 is provided. In particular, this method includes the steps of forming the activation member 12, which includes the body 18 with a front surface 20 and a rear surface 22. The illumination member 14 is positioned substantially adjacent, spaced from or near to the rear surface 22 of the body 18, such that, in operation, the illumination member 14 projects the visible waves W toward the rear surface 22 of the body 18. The positioning of the illumination member 14 with respect to the activation member 12 is variable in order to achieve any of the desired effects. For example, the illumination member 14 may be in the form of a screen that is placed immediately behind or even within a cut-out portion 24. When the body 18 of the activation member 12 is opaque or non-transparent, the illumination member 14 may be spaced from the rear surface 22 of the body 18, such that the waves W project around the body 18. Any number of similar arrangements and positioning options are envisioned in order to achieve the desired effect.

If desired, and in the manufacturing process, the cut-out portions 24 can be formed and extend at least partially through the body 18 of the activation member 12. In addition, as discussed above, the cut-out portions 24 may be at least partially filled with the material 28. It is envisioned that the cut-out portions 24 may be formed through a variety of processes. For example, these cut-out portions 24 may be formed through a laser cutting process, a water jet cutting process, a chemical etching process, etc.

As discussed above, the material 28 may be in a variety of forms and manufactured from a variety of materials. Similarly, the activation member 12 (and, in particular, the body 18 of the activation member 12) may be formed from a variety of materials as well. For example, the activation member 12 may be formed from a steel material, stainless steel, carbon steel, an alloy, brass, synthetic material, wood, an epoxy, a resin, a polymer, a plastic, a transparent material, a semi-transparent material, a colored material, a glass, etc.

Overall, the present invention provides an activation device 10 that can be used in a variety of positions and locations and provide both functional and ornamental benefits. The activation device 10 may be appropriately lit for low-light or darkened conditions. Additionally, the activation device 10, and in particular the illumination member 14, may provide a variety of ornamental, colorful, or even informational source benefits. As discussed above, the illumination member 14 may be in the form of a screen surface 26, which may be interactive, and provides an increased functionality to the activation device 10 and resulting system.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An activation device for use in initiating an event, the device comprising:

an activation member having a body with a front surface and rear surface; and an illumination member positioned substantially adjacent or spaced from the rear surface of the body of the activation member and configured to project visible waves toward the rear surface of the body of the activation member, wherein:

the body of the activation member includes a plurality of cut-out portions extending therethrough that has no material therein, said cut-out portions together forming a design; and the visible waves projected by the illumination member pass through the at least one cut-out portion for receipt by a user without passing through a material of the activation member.

2. The device of claim 1, wherein the design is a sign, at least one word, at least one number, at least one symbol, a phrase, a direction, a representation, a figure, an image, an alphanumeric character, or any combination thereof.

3. The device of claim 1, wherein the illumination member is a LED source, an OLED source, a thin-film transistor source, a light, a lamp, a screen, a video display screen, a television screen, a monitor, a flat screen, a plasma screen, a LCD screen, an illumination source, or any combination thereof.

4. The device of claim 3, wherein the illumination member includes a screen surface, and wherein at least one of the cut-out portions is sized and shaped so as to allow the screen surface to be at least partially visible through the cut-out portion.

5. The device of claim 1, wherein the illumination member is in electrical communication with a power device configured to provide current to the illumination member.

6. An activation device for use in initiating an event, the device comprising:

an activation member having a body with a front surface and rear surface; and an illumination member positioned substantially adjacent or spaced from the rear surface of the body of the activation member and configured to project visible waves toward the rear surface of the body of the activation member, wherein:

the body of the activation member includes at least one cut-out portion extending therethrough that has no material therein;

the visible waves projected by the illumination member pass through the at least one cut-out portion for receipt by a user without passing through a material of the activation member; and the activation member is a touch plate, which, when contacted by a user, is in communication with a switch mechanism, such that when the switch mechanism is actuated, the event is initiated.

7. The device of claim 6, wherein the touch plate is moveable between a contact position and a non-contact position, and wherein the touch plate is urged into a non-contact position by a spring mechanism in operational communication with the touch plate.

8. The device of claim 6, wherein the illumination member is a LED source, an OLED source, a thin-film transistor source, a light, a lamp, a screen, a video display screen, a television screen, a monitor, a flat screen, a plasma screen, a LCD screen, an illumination source, or any combination thereof.

9. The device of claim 8, wherein the illumination member includes a screen surface, and wherein the cut-out portion is sized and shaped so as to allow the screen surface to be at least partially visible through the cut-out portion.

10. The device of claim 6, wherein the illumination member is in electrical communication with a power device configured to provide current to the illumination member.

11. An activation device for use in initiating an event, the device comprising:

an activation member having a body with a front surface and rear surface; and an illumination member positioned substantially adjacent or spaced from the rear surface of the body of the activation member and configured to project visible waves toward the rear surface of the body of the activation member, wherein:

the body of the activation member includes at least one cut-out portion extending therethrough that has no material therein;

the visible waves projected by the illumination member pass through the at least one cut-out portion for receipt by a user without passing through a material of the activation member; and the activation member is a contact-less plate in communication with a sensor, which is in communication with a communication unit, wherein through contact-less interaction between the user and the sensor, a command is issued to initiate the event through the communication unit.

12. The device of claim 11, wherein the illumination member is a LED source, an OLED source, a thin-film transistor source, a light, a lamp, a screen, a video display screen, a television screen, a monitor, a flat screen, a plasma screen, a LCD screen, an illumination source, or any combination thereof.

13. The device of claim 12, wherein the illumination member includes a screen surface, and wherein the cut-out portion is sized and shaped so as to allow the screen surface to be at least partially visible through the cut-out portion.

14. The device of claim 11, wherein the illumination member is in electrical communication with a power device configured to provide current to the illumination member.

* * * * *

UNITED STATES PATENT AND TRADEMARK OFFICE

CERTIFICATE OF CORRECTION

PATENT NO. : 7,967,459 B2
APPLICATION NO. : 11/452495
DATED : June 28, 2011
INVENTOR(S) : Schluep et al.

It is certified that error appears in the above-identified patent and that said Letters Patent is hereby corrected as shown below:

In column 6, line 57, delete “piezzo” and insert -- piezo --, therefor.

Signed and Sealed this
Eighth Day of November, 2011

David J. Kappos

David J. Kappos
*Director of the United States Patent and Trademark Office*